US007947924B2

(12) United States Patent
Niiyama et al.

(10) Patent No.: US 7,947,924 B2
(45) Date of Patent: May 24, 2011

(54) COOKING DEVICE

(75) Inventors: Koji Niiyama, Hyogo (JP); Masamichi Komada, Hyogo (JP); Seiji Nakamura, Hyogo (JP)

(73) Assignee: Panasonic Corporation, Osaka (JP)

( * ) Notice: Subject to any disclaimer, the term of this patent is extended or adjusted under 35 U.S.C. 154(b) by 618 days.

(21) Appl. No.: 11/815,793

(22) PCT Filed: Oct. 25, 2006

(86) PCT No.: PCT/JP2006/321241

§ 371 (c)(1),
(2), (4) Date: Aug. 8, 2007

(87) PCT Pub. No.: WO2007/058058

PCT Pub. Date: May 24, 2007

(65) Prior Publication Data

US 2009/0020516 A1 Jan. 22, 2009

(30) Foreign Application Priority Data

Nov. 16, 2005 (JP) ..... 2005-331073

(51) Int. Cl.

| | |
|---|---|
| ***H05B 1/00*** | (2006.01) |
| ***H05B 1/02*** | (2006.01) |
| ***H05B 6/06*** | (2006.01) |
| ***H05B 6/12*** | (2006.01) |

(52) U.S. Cl. ..... 219/209; 219/497; 219/507; 219/622

(58) Field of Classification Search ..... 219/209.497, 219/662, 663, 620, 627, 412, 414, 443.1, 219/448.12, 491, 507, 445.1, 427, 220, 622; 362/97.1; 361/179, 181; 307/116, 130; 174/126.4
See application file for complete search history.

(56) References Cited

U.S. PATENT DOCUMENTS 5,867,111 A 2/1999 Caldwell et al.

(Continued)

FOREIGN PATENT DOCUMENTS

EP 1 582 819 A1 10/2005

(Continued)

OTHER PUBLICATIONS

Japan Office Action for Application No. 2005-331073, Oct. 26, 2010, Panasonic Corporation, Page 3, middle, where cite Nos. 1 to 6 are referenced.

(Continued)

*Primary Examiner* — Geoffrey S. Evans
*Assistant Examiner* — Vinod D Patel
(74) *Attorney, Agent, or Firm* — Ratnerprestia

(57) ABSTRACT

A heating cooking device includes a top plate, a heating unit, a touch key including a first electrode and a second electrode, an input unit for applying an alternating current (AC) voltage to the second electrode and for outputting a voltage changing according to a change of the AC voltage when the first electrode is pushed, a detector for outputting a first signal if the voltage output from the input unit changes from the reference value to the first value, an operation judging unit for outputting a second signal according to a rate of change of the voltage output from the input unit, and a controller operable to perform control of the heating unit based on the first and second signals. The controller is operable to perform control of energization of the heating unit if the controller does not receive the second signal after receiving the first signal, and not to perform the control of the energization of the heating unit if the controller receives the second signal after receiving the first signal.

10 Claims, 3 Drawing Sheets

U.S. PATENT DOCUMENTS

| | | | | |
|---|---|---|---|---|
| 7,102,109 | B2 * | 9/2006 | Niiyama et al. | 219/627 |
| 7,157,674 | B2 * | 1/2007 | Miyauchi et al. | 219/621 |
| 7,173,224 | B2 * | 2/2007 | Kataoka et al. | 219/620 |
| 7,186,955 | B2 * | 3/2007 | Fisher et al. | 219/486 |
| 7,335,861 | B2 | 2/2008 | Gama et al. | |
| 7,626,148 | B2 * | 12/2009 | Ito | 219/620 |
| 7,786,413 | B2 * | 8/2010 | Itou et al. | 219/489 |
| 2003/0122432 | A1 * | 7/2003 | Caldwell | 307/125 |
| 2005/0235983 | A1 | 10/2005 | Gama et al. | |
| 2010/0214253 | A1 * | 8/2010 | Wu et al. | 345/174 |

FOREIGN PATENT DOCUMENTS

| | | | |
|---|---|---|---|
| JP | 61-292832 | | 12/1986 |
| JP | 2003-224459 | A | 8/2003 |
| JP | 2003-279055 | | 10/2003 |
| JP | 2005-085667 | | 3/2005 |
| JP | 2005-085667 | A | 3/2005 |
| JP | 2005-158651 | A | 6/2005 |
| JP | 2005-166392 | A | 6/2005 |
| JP | 2005-291510 | A | 10/2005 |
| JP | 2005-291512 | | 10/2005 |
| JP | 2005-302545 | | 10/2005 |
| JP | 2005-317237 | | 11/2005 |
| JP | 2006-185745 | | 7/2006 |
| JP | 2006-185745 | A | 7/2006 |
| JP | 2005-166392 | A | 6/2010 |

OTHER PUBLICATIONS

International Search Report for Application No. PCT/JP2006/321241 dated Jan. 23, 2007.

Supplementary European Search Reoprt for EP 06 82 2218, Jun. 1, 2010.

* cited by examiner

COOKING DEVICE

This Application is a U.S. National Phase Application of PCT International Application PCT/JP2006/321241.

TECHNICAL FIELD

The present invention relates to a heating cooking device, such as an induction heating cooking device, including a touch key of static capacitance detecting type.

BACKGROUND ART

Induction heating cooking devices have been widely used as providing advantages, such as safety, cleanness, and high efficiency, and applied for use in home or commercial kitchens.

Japanese Patent Laid-Open Publication No. 61-292832 discloses a conventional touch key of capacitance detecting type. This touch key includes a flat panel and electrodes provided on both surfaces of the panel to form a capacitor. The change of the static capacitance of the capacitor caused by the touch of one electrode with a finger is converted into the change of a direct current (DC) voltage.

Japanese Patent Laid-Open Publication No. 2005-85667 discloses another conventional induction heating cooking device including a touch key of static capacitance detecting type. This cooking device includes plural touch keys of static capacitance detecting type and a controller for receiving signals from the touch keys. The controller receives the signals successively while being synchronized with a commercial power supply, and changes the order of the signals to be received at a predetermined interval. This operation allows the controller to detect that the touch keys are close to a cooking pan without being affected by leaking magnetic field.

In these conventional touch keys of static capacitance detecting type may erroneously start or stop heating operation as if the touch keys are activated by a finger when a user spills water on the keys or when cooked material is boiled over from a cooking pan onto the keys.

SUMMARY OF THE INVENTION

A heating cooking device includes a top plate arranged to have an object to be heated placed thereon, a heating unit for heating the object, a touch key including a first electrode and a second electrode facing each other across the top plate, an input unit for applying an alternating current (AC) voltage to the second electrode and for outputting a voltage changing according to a change of the AC voltage when the first electrode is pushed, a detector for outputting a first signal if the voltage output from the input unit changes from the reference value to the first value, an operation judging unit for outputting a second signal according to a rate of change of the voltage output from the input unit, and a controller operable to perform control of the heating unit based on the first and second signals. The input unit outputs a voltage changing from a reference value to a first value and consecutively changing towards the reference value according to a change of a capacitance between the first and second electrodes. The detector outputs a first signal if the voltage output from the input unit changes from the reference value to the first value. The operation judging unit outputs a second signal according to a rate of change of the voltage output from the input unit which changes towards the reference value consecutively after changing from the reference value to the first value. The controller is operable to perform control of energization of the heating unit if the controller does not receive the second signal after receiving the first signal, and not to perform the control of the energization of the heating unit if the controller receives the second signal after receiving the first signal.

This heating cooking device does not erroneously operate even when the touch key contacts conductive material, such as water.

REFERENCE NUMERALS

1 Top Plate
2 Cooking Pan (Object to Be Heated)
3 Heating Unit
4 Touch Key
5A Electrode (First Electrode)
5B Electrode (Second Electrode)
6 Input Unit
7 Detector
8 Operation Judging Unit
9 Reference Updating Unit
10 Controller

DETAIL DESCRIPTION OF THE PREFERRED EMBODIMENT

Figure 1:
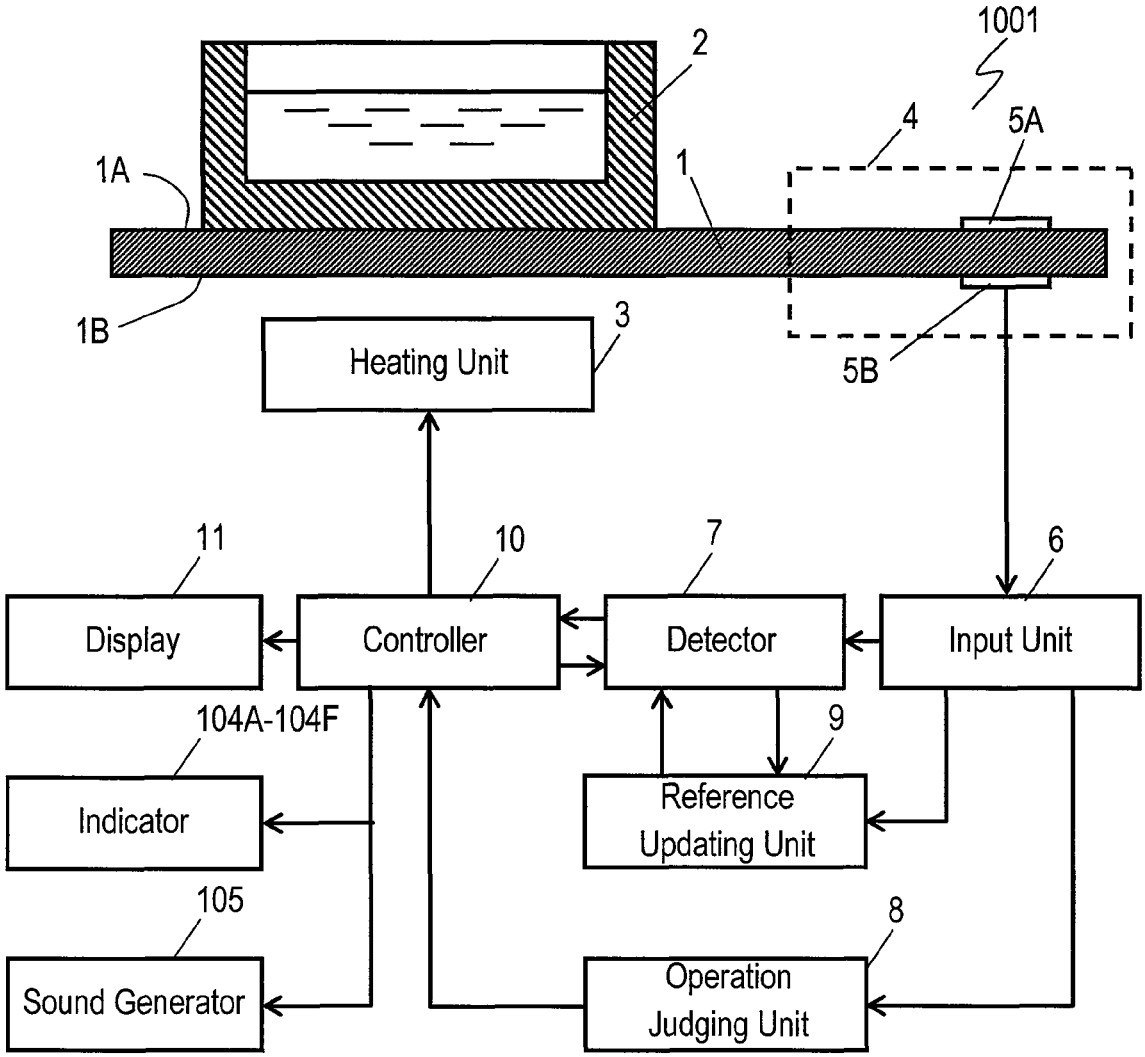
FIG. 1 is a block diagram of a heating cooking device according to an exemplary embodiment of the present invention.

FIG. 1 is a block diagram of a heating cooking device 1001 according to an exemplary embodiment of the present invention. The heating cooking device 1001 is an induction heating cooking device. A cooking pan 2, an object to be heated, is placed on an upper surface 1A of a top plate 1 having an electrically insulating property. A heating unit 3 includes an inverter circuit and a heating coil. The inverter circuit includes a rectifier and a switching element for converting an output of the rectifier into a high-frequency current, and is connected to the commercial power source. Plural touch keys 4 are mounted on the top plate 1. Each touch key 4 includes electrodes 5A and 5B provided on the upper surface 1A and a lower 1B of the top plate 1, respectively, thus to form a capacitor. Indicators 104A to 104F illuminate when the touch keys 4 are pushed. A sound generator 105 generates a sound when the touch key 4 is pushed.

An input unit 6 applies an alternating-current (AC) voltage to the electrode 5B, converts the AC voltage into a direct-current (DC) voltage, and outputs the DC voltage. A detector 7 detects that, based on the voltage output from the input unit 6, the touch key 4 is pushed, i.e., a finger of a user contacts the electrode 5B. A controller 10 controls energization of the heating unit 3 based on an output of the detector 7. An operation judging unit 8 judges whether or not the touch key 4 is activated with a finger of a human based on a rate of the change of the voltage received from the input unit 6 after the touch key 4 is pushed. When the operation judging unit 8 judged that the touch key 4 is activated not with the finger, the controller 10 cancels the pushing of the touch key 4 detected by the detector 7.

A reference updating unit 9 changes a reference value which is used for judging of the pushing of the touch key 4 based on the voltage output from the input unit 9 if the detector 7 detects that the touch key 4 is continued to press for a predetermined period of time after the detector 7 detects that the touch key 4 is pushed. The reference updating unit 9 stores the lowest voltage after the detector 7 detects that the touch key 4 is pushed, and changes the reference value according to the lowest voltage.

If the operation judging unit 8 judges that the key 4 is activated not with by the finger, i.e., if the controller 10 receives the signal from the touch key 4 due to conductive material, such as water, spilt on the top plate 1 triggers the action of the touch key 4, a display 11 notifying the user of the judgment result.

Figure 2:
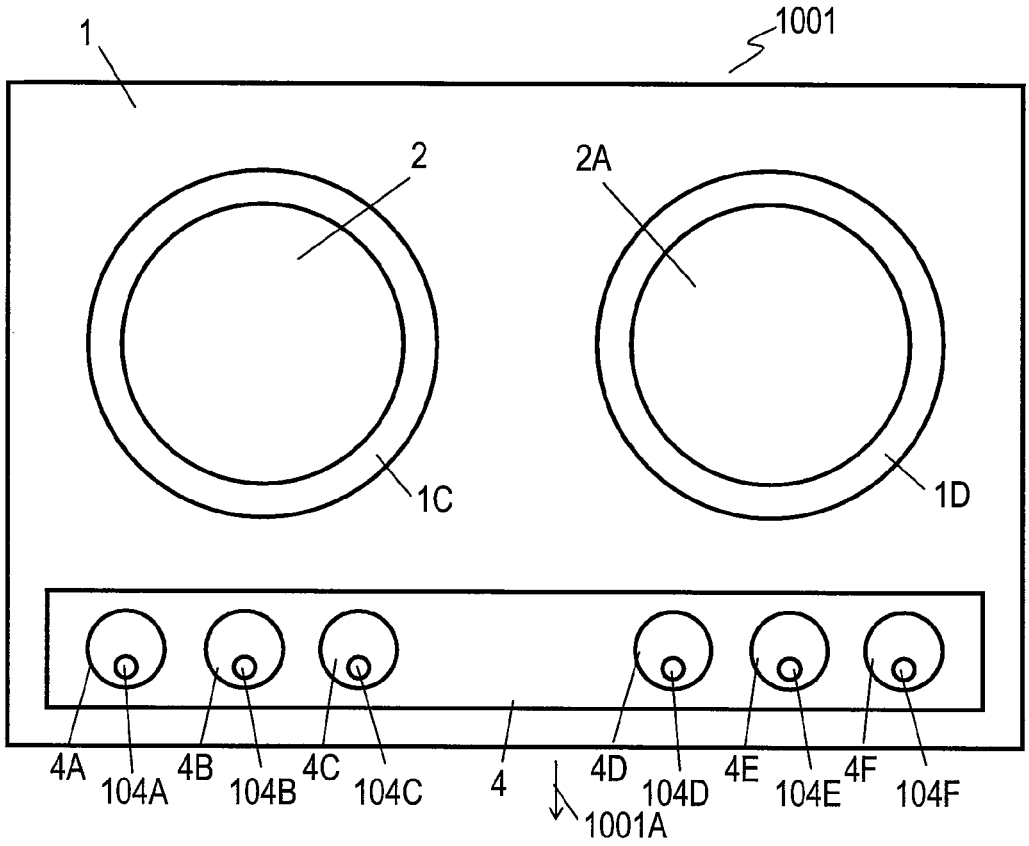
FIG. 2 is a plan view of the heating cooking device according to the embodiment.

FIG. 2 is a plan view of the heating cooking device 1001 according to the embodiment. The heating cooking device 1001 is activated by the user from a direction 1001A. Cooking pans 2 and 2A can be placed on the upper surface 1A of the top plate 1. The top plate 1 includes a heating coil position indicator 1C for displaying the position of a heating coil of the heating unit 3 to heat the cooking pan 2 and another heating coil position indicator 1D for displaying the position of a heating coil of a heating unit 3A to heat the cooking pan 2A. The heating unit 3 is positioned at the left of the heating unit 3A. The touch keys 4 includes a left down key 4A, a left on/off key 4B, a left up key 4C, a right down key 4D, a right on/off key 4E, and a right up key 4F. The left down key 4A decreases the setting of a power of the heating unit 3 for heating the cooking pan 2 or the setting of a temperature at the cooking pan 2. The left on/off key 4B turns on and off the heating unit 3. The left up key 4C increases the setting of a power of the heating unit 3 for heating the cooking pan 2 or the setting of a temperature at the cooking pan 2. The right down key 4D decreases the setting of a power of the heating unit 3A for heating the cooking pan 2A or the setting of a temperature at the cooking pan 2A. The right on/off key 4E turns on and off the heating unit 3A. The right up key 4F increases the setting of a power of the heating unit 3A for heating the cooking pan 2A or the setting of a temperature at the cooking pan 2A. The indicators 104A to 104F illuminate when touch keys 4A to 4F are pushed, respectively.

Each of the touch keys 4A to 4F includes the electrode 5A provided on the upper surface 1A of the top plate 1 and the electrode 5B provided on the lower surface 1B of the top plate 1. The touch keys 4A to 4F in the direction 1001A which is closer to the user than each of the cooking pans 2 and 2A is so as to be activated easily by the user.

Figure 3:
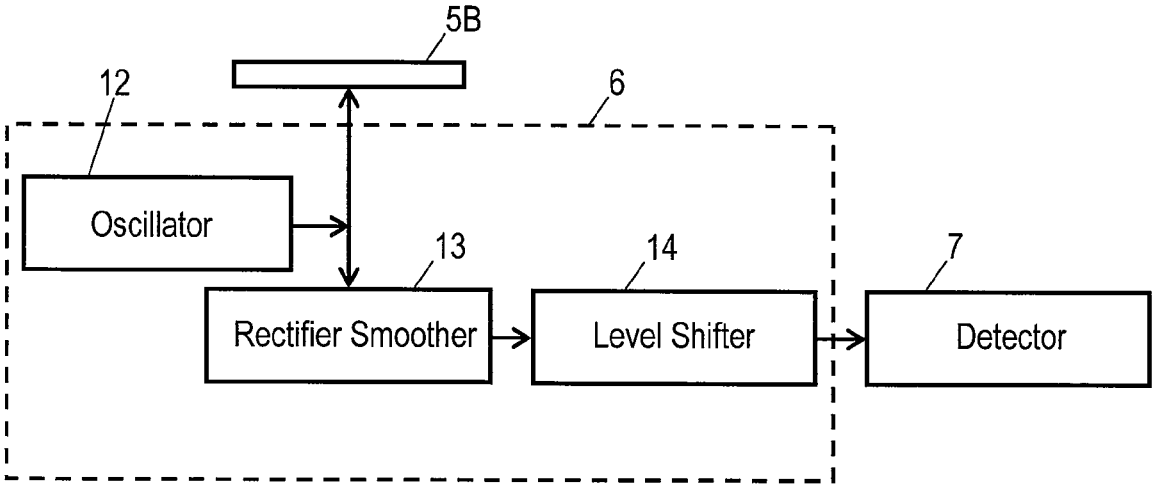
FIG. 3 is a block diagram of an input unit of the heating cooking device according to the embodiment.

FIG. 3 is a block diagram of the input unit 6. The input unit 6 includes an oscillator 12, a rectifier smoother 13, and a level shifter 14. The oscillator 12 applies the AC voltage, the high-frequency voltage of 400 kHz, to the electrode 5B. When the user does not contact the electrode 5A with a finger, the high-frequency voltage applied to the electrode 5B is rectified and smoothed by the rectifier smoother 13, thus being converted into a DC voltage. The level shifter 14 changes the absolute vale of the DC voltage, thereby providing the DC voltage with a difference of values which is detectable, and supplies the DC voltage to a microcomputer composing the detector 7. When the finger contacts the electrode 5A, a portion of the high-frequency voltage applied to the electrode 5B is transmitted via the user to the ground. Then, the amplitude of the high-frequency voltage input to the rectifier smoother 13 decreases, accordingly decreasing the DC voltage into to the detector 7. The electrode 5B composing each of the six touch keys 4A to 4F of touch keys 4 is connected to the input unit 6. In other words, the heating cooking device 1001 includes six of the input units 6.

The heating unit 3 is the switching element and the heating coil. The switching element is turned on and off at the frequency of 23 kHz to supply a high-frequency current to the heating coil. The heating coil, upon receiving the high-frequency current, generates a high-frequency magnetic flux, thereby inductively heating the cooking pan 2 magnetically coupled. The display 11 includes a light emitting diode (LED) or a liquid crystal display (LCD) which indicates the energization of the heating unit 3.

The electrodes 5A and 5B having the insulating top plate 1 provided between the electrodes provides a capacitor. The input unit 6 applies the alternating current, the high-frequency voltage of 400 kHz, to the electrode 5B, and rectifies and smoothes the applied voltage to convert the AC voltage into a DC voltage. When the finger of the user contacts the electrode 5A, the amplitude of the high-frequency voltage applied to the electrode 5B changes, and the input unit 6 converts the change of the amplitude of the high-frequency voltage into the change of the DC voltage. According to the change of the high-frequency voltage, the input unit 6 outputs a voltage changing from the reference value to a first voltage and consecutively changing from the first value towards the reference value.

The detector 7 analog-to-digital converts the voltages output from the input units 6 connected to touch keys 4A to 4F successively. When the output voltage decreases to a value lower than the reference value by a predetermined value, the detector 7 judges that the touch key 4 is pushed, and supplies, to the controller 10, a first signal indicating the pushing of the touch key for each of touch keys 4A to 4F.

While the user does not contact each of the touch keys 4A to 4F, the detector 7 reads voltages output from the input unit 6 plural times, and stores the average value of the voltages as the reference value. A voltage of 0.4V decreasing from the reference value is determined based on circuitry, and changes according to the change of the circuitry, thus not being limited to this value.

The operation judging unit 8 detects a rate of change during the rising of the voltage from the time when the detector 7 detects the pushing of the key, and judges whether or not the user pushes the key. In the heating cooking device 1001 according to this embodiment, the detector 7 judges that the key is pushed when a voltage lower than the reference vale by more than 0.4V is input from the input unit 6, and after that, judges that the key is released when a voltage lower than the reference value by 0.2V is input from the input unit 6. The operation judging unit 8 thus measures a period of time during which the voltage output from the input unit 6 changes from a voltage lower than the reference voltage by 0.4V to a voltage lower than the reference value by 0.2V. If the period of time is not shorter than a predetermined period of time, e.g. 0.5 second, the operation judging unit 8 judges that the key is activated by the finger of the user. If the period of time exceeds 0.5 seconds, the operation judging unit 8 judges that conductive material, such as water or cooked material, contacts the key, and output a second signal the controller 10.

The controller 10 controls the energization of the heating unit 3 based on the first signal output from the detector 7 and the second signal output from the operation judging unit 8.

The controller 10 performs control of the energization of the heating unit 3, i.e., changes a power supplied to heating unit 3 based on the first signal output from the detector 7. The controller 10 controls the heating unit 3 corresponding to the touch keys 4A to 4F based on the first signal from the detector 7. At this moment, the controller 10 drives the indicators 104A to 104F to illuminate and the sound generator 105 to generate a sound. That is, upon receiving the first signal from the detector 7, the controller 10 notifies the user of the pushing of the touch keys 4A to 4F by outputting, to the user, indications, such as illumination from the indicators 104A to 104F and the sound from the sound generator 105. Upon receiving the second signal from the operation judging unit 8, the controller 10 stops the energization of the heating unit 3. Further, at this moment, if the indications (such as illuminations of the indicators 104A to 104F) indicating the pushing of the touch keys 4A to 4F continue, the controller 10 stops the indications, and allows the display 11 to notify the user of defect of any one of the touch keys 4A to 4F.

An operation of the heating cooking device 1001 will be described below.

Figure 4A:
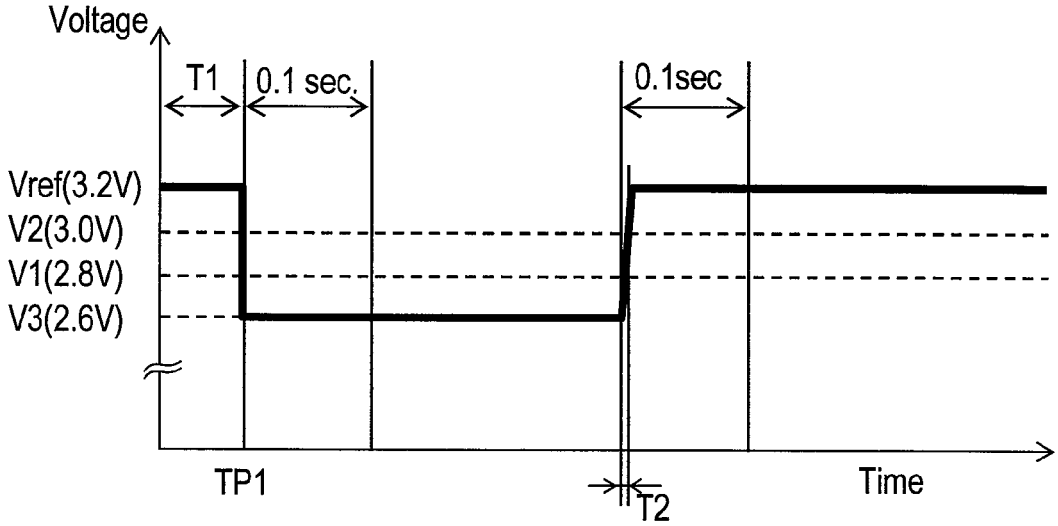
FIG. 4A illustrates a voltage output from the input unit of the heating cooking device according to the embodiment.

FIG. 4A illustrates the voltage output from the input unit 6 when the user contacts the electrode 5B of the touch panel. The input unit 6 outputs the DC voltage. As shown in FIG. 4A, when the user does not contact the touch key 4 with a finger, the input unit 6 outputs the DC voltage of 3.2V. The detector 7 analog-to-digital converts this voltage, and stores the converted voltage as the reference value Vref.

Then, for example, when the user contacts the electrode 5B of the left on/off key 4B for turning on and off the heating unit 3 at a time point TP1, the voltage output from the input unit 6 connected with the left on/off key 4B decreases at the time point TP1 from the reference value Vref (3.2 V) to a first value V3 (2.6 V). If the voltage continues to be lower than a first judging value V1 (2.8 V) which is lower than the reference value Vref by 0.4V for a predetermined period of time, e.g. 0.1 seconds after the time point TP1, the detector 7 judges that the left on/off key 4B is pushed, and outputs the first signal. Upon receiving the first signal, the controller 10 starts the energization of the heating unit 3. At this moment, the controller 10 drives the indicator 104B to illuminate and drives the sound generator 105 to generate a sound.

Figure 4B:
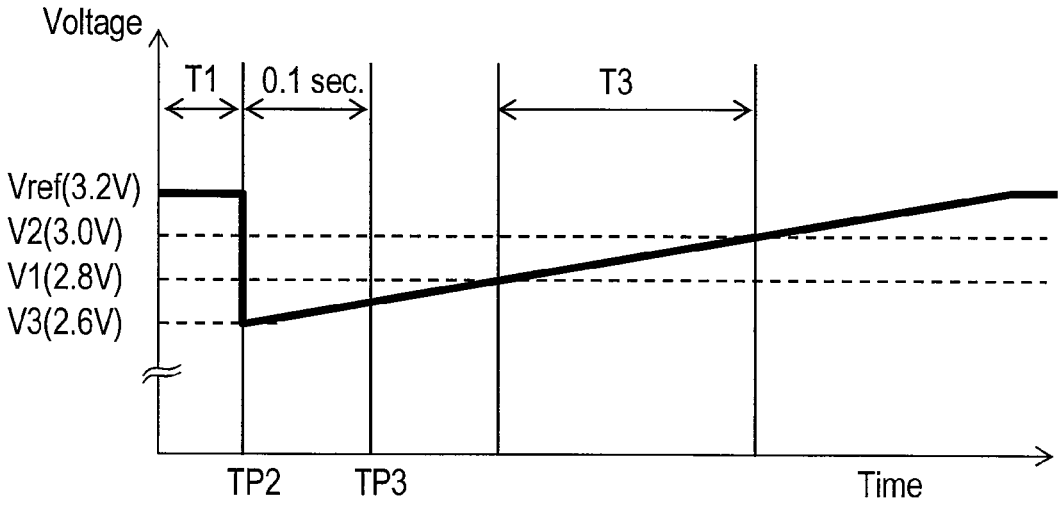
FIG. 4B illustrates a voltage output from the input unit of the heating cooking device according to the embodiment.

FIG. 4B illustrates a voltage output from the input unit 6 when the conductive material, such as water or cooked material, contacts the electrode 5B of the touch panel. For example, when the conductive material, such as water or cooked material, is spilt and contacts the left on/off key 4B at the time point TP2 while the heating unit 3 does not operates, e.g. no cooking operation, the voltage output from the input unit 6 connected with the left on/off key 4B decreases, at the time point TP2, from the reference value Vref (3.2 V) to the first value V3 (2.6 V) which is lower than the first judging value V1 (2.8 V). When the voltage continues to be lower than the first judging value V1 from the time point TP2 to the time point TP3 which is 0.1 seconds after the time point TP2, the detector 7 judges that the left on/off key 4B is pushed, and starts the energization of the heating unit 3. At this moment, the controller 10 drives the indicator 104B to illuminate and drives the sound generator 105 to generate a sound.

The conductive material, such as water or cooked material, spilled on the top plate 1 spreads according to lapse of time, and has an amount on the touch key 4B decrease gradually. The decreasing of the amount changes the static capacitance of the capacitor including the electrodes 5A and 5B, and causes the voltage output from the input unit 6 to rise, accordingly increasing the voltage output from the input unit 6. According to the lapse of time from the time point TP2, the amount of the conductive material contacting the electrode 5 of the touch key 4B decreases, and accordingly, the voltage output from the input unit 6 gradually rises up to the reference value Vref. The operation judging unit 8 measures the period T3 of time T3 during which the voltage output from the input unit 6 rises from the first judging value V1 (2.8) to a second judging value V2 (3.0 V) which is lower than the reference value Vref by 0.2V i.e., which is higher than the first judging value V1 by 0.2V. When the period T3 of time exceeds a predetermined period of time, e.g. 0.5 seconds, the operation judging unit 8 judges that the electrode 5B of the touch key 4B is contacted by the conductive material, such as water or cooked material, not by the finger of the user, and outputs, to the controller 10, a signal for stopping the operation of the heating unit 3. In turn, the controller 10 stops the energization of the heating unit 3. In other words, the controller 10 cancels the control of energizing the heating unit 3. As shown in FIG. 4B, when the user releases the touch key 4B after the user continues pushing the key, the electrode 5A opens, and the capacitor including the electrodes 5A and 5B is disconnected from the ground, thus quickly increasing the voltage output from the input unit 6. The period T2 of time, shown in FIG. 4A, during which the voltage rises from the first judging value V1 to the second judging value V2 is shorter than the period T3 of time, shorter than 0.5 seconds, shown in FIG. 4B. Thus, if the period of time during which the voltage output from the input unit 6 rises from the first judging value V1 to the second judging value V2 is shorter than 0.5 second, the operation judging unit 8 judges that the user contacts the touch key 4B and drives the controller 10 to continue to drive the heating unit 3 to energize the heating unit 3.

When the average of the rate of change of the voltage output from the input unit 6 is not higher than a difference calculated by subtracting a predetermined value from the maximum rate of change, the operation judging unit 8 judges that the touch key is activated no by the finger of the user. While the finger of the user pushes the touch key 4, the change of the DC voltage output from the input unit 6 is small. When the finger contacts the touch key 4 or when the finger is removed from the touch key 4, the DC voltage changes at the maximum rate, thus changes at a large rate. If water spilt on the top plate 1 and reaches the touch key 4, the water reaching the touch key 4 spreads on the top plate. The DC voltage output from the input unit 6 accordingly changes gradually and continuously, and thus, the average of the rate of the change of the voltage is small. Based on this change, heating cooking device 1001 according to this embodiment can judge easily and reliably whether or not the user activates the touch key with the finger.

If conductive material, such as water or cooked material, contacts the left on/off key 4B while the controller 10 energizes the heating unit 3, the detector 7 sends a signal to the controller 10 for stopping the energization of the heating unit 3. However, the operation judging unit 8 judges by the above method that the key 4B is activated not by the user, and sends a signal to the controller 10 to restart the energization of the heating unit 3. This operation allows the heating cooking device 1001 to restart cooking operation instantly even when an automatic cooking procedure of the cooking device is interrupted by an erroneous detecting of the touch key.

Thus, the heating cooking device 1001 according to this embodiment can operate safely and be used easily while being prevented from operating erroneously due to the erroneous detection of the key.

In the heating cooking device 1001 according to this embodiment, the DC voltage output from the input unit 6 increases when the temperature of the circuitry rises due to the thermal characteristic of each circuit component. In order to prevent the touch key from operating erroneously, when the detector 7 and the operation judging unit 8 judge that the user contacts the touch key 4, the reference value is not updated.

However, when the key 4 is pushed continuously for more than three minutes, the reference updating unit 9 updates the reference value Vref to the value provided by adding 0.4V to the voltage output at that moment from the input unit 6. When the detector 7 does not detect that the touch key 4 is not released for more than a predetermined period of time, e.g. three minutes, after the detector 7 outputs the first signal, that is, when the detector detects that the touch key 4 is pushed continuously for more than the predetermined period of time after the detector 7 outputs the first signal, the reference updating unit 9 changes the reference value Vref. This operation allows the detector 7 and the operation judging unit 8 to detect the pushing of the touch key 4, further, to detect whether or not the user activates the touch key, even the DC voltage changes according to temperature characteristics of circuit components due to a frying pan or a cooking pan at high temperatures placed on the touch key 4.

The reference updating unit 9 stores the smallest value of the DC voltage output from the input unit 6 while it is judged that the touch key 4 is pushed, and updates the reference value Vref to a value determined by adding 0.4V to the smallest value. This operation allows the detector 7 and the operation judging unit 8 to correctly judge reliably whether or not the user pushes the touch key 4 even when the temperature falls.

A heating cooking device including a capacitor including a top plate, an upper surface electrode (electrode 5A) on an upper surface of the plate, and a lower surface electrode (electrode 5B) on a lower surface of the plate can detects that a user contacts the upper surface electrode by converting a high-frequency voltage supplied to the lower surface electrode into a DC voltage. In such heating cooking device, a leakage magnetic field generated by a heating unit is introduced via a pan, and generates a ripple voltage. The ripple voltage may be added to the DC voltage, and prevent the cooking device from accepting the user's activation of the key. The heating cooking device 1001 according to this embodiment solves this problem.

According to this embodiment, the controller 10 starts the energization of the heating unit 3 upon receiving the first signal from the detector 7, drives the indicators 104A to 104F to illuminate, and drives the sound generator 105 to generate a sound. Upon receiving the first signal from the detector 7, the controller 10 drives the indicators 104A to 104F to illuminate and drives the sound generator 105 to generate a sound, but may not necessarily start the energization of the heating unit 3. That is, the controller 10 may perform an accepting operation (the illuminating and the generating of sound) upon receiving the first signal. In this case, the controller 10 does not energize the heating unit 3 if receiving the second signal from the operation judging unit 6 within a predetermined period of time after receiving the first signal from the detector 7. Further, the controller 10 starts the energization of the heating unit 3 if the controller does not receive the second signal from the operation judging unit 6 within a predetermined period of time after receiving the first signal from the detector 7. The timing for starting the energization of the heating unit 3 after receiving the first signal from the detector 7 may arbitrarily be determined. For example, the controller 10 may start the energization of the heating unit 3 when receiving the first signal, or the controller 10 may start the energization of the heating unit 3 after a predetermined delay period of time from receiving of the first signal. The controller 10 may operate to perform control of the energization of the heating unit 3 if the controller does not receive the second signal within a predetermined period of time after receiving the first signal, and not to perform the control of the energization of the heating unit 3 when receiving the second signal within the predetermined period of time after receiving of the first signal.

Either of the illumination of the indicators 104A to 104F or the generation of sound from the sound generator 105 or both of them may not be performed.

The present invention is not limited to the above embodiment.

INDUSTRIAL APPLICABILITY

A heating cooking device according to the present invention does not erroneously operate even when the touch key contacts conductive material, such as water, and is useful to cooking apparatuses including a touch key, such as induction heating cooking devices, high-frequency heating cooking devices, or halogen cooking devices.

The invention claimed is:

1. A heating cooking device comprising:

a top plate having an upper surface and a lower surface, the upper surface being arranged to have an object to be heated placed thereon;

a heating unit for heating the object;

a touch key including a first electrode and a second electrode, the first electrode being provided on the upper surface of the top plate, the second electrode being provided on the lower surface of the top plate and facing the first electrode across the top plate;

an input unit for applying an alternating current (AC) voltage to the second electrode, and for outputting a voltage changing from a reference value to a first value and consecutively changing towards the reference value according to a change of the AC voltage when the first electrode is pushed;

a detector for outputting a first signal if the voltage output from the input unit changes from the reference value to the first value;

an operation judging unit for outputting a second signal according to a rate of change of the voltage output from the input unit which changes towards the reference value consecutively after changing from the reference value to the first value; and a controller operable to perform control of energization of the heating unit if the controller does not receive the second signal after receiving the first signal, and not to perform the control of the energization of the heating unit if the controller receives the second signal after receiving the first signal.

2. The heating cooking device according to claim 1, wherein the controller is operable to perform the control of the energization of the heating unit if the controller receives the first signal, and not to perform the control the energization of the heating unit if the controller receives the second signal.

3. The heating cooking device according to claim 1, wherein the operation judging unit outputs the second signal if an average of the rate of the change of the voltage output from the input unit is smaller than a largest value of the rate of the change of the voltage by a predetermined value.

4. The heating cooking device according to claim 1, wherein the detector outputs the first signal if the voltage output from the input unit changes from the reference value to a value lower than a first judging value which is lower than the reference value.

5. The heating cooking device according to claim 4, wherein the operation judging unit outputs the second signal, after the voltage output from the input unit changes from the reference value to a value lower than the first judging value, if a period of time during which the voltage output from the input unit 6 changes from the first judging value to a second judging value which is between the first judging value and the reference value is not shorter than a second predetermined period of time.

6. The heating cooking device according to claim 4, further comprising a reference updating unit for changing the reference value if the detector does not detect that the touch key is released for a period of time longer than a third predetermined period of time after the detector outputs the first signal.

7. The heating cooking device according to claim 6, wherein the reference updating unit changes the reference value based on a lowest value of the voltage output from the input unit after the detector detects the touch key is pushed.

8. The heating cooking device according to claim 4, further comprising a reference updating unit for changing the reference value if the detector detects that the touch key is pushed for a period of time longer than a predetermined third period of time after the detector outputs the first signal.

9. The heating cooking device according to claim 8, wherein the reference updating unit changes the reference value based on a lowest value of the voltage output from the input unit after the detector detects that the touch key is pushed.

10. The heating cooking device according to claim 1, wherein the controller is operable to output an indication to a user if the controller receives the first signal from the detector.

* * * * *